US010344633B2

(12) United States Patent
Gaisberg-Helfenberg et al.

(10) Patent No.: US 10,344,633 B2
(45) Date of Patent: Jul. 9, 2019

(54) ADJUSTING DEVICE, IN PARTICULAR FOR ADJUSTING A CAMSHAFT OF AN INTERNAL COMBUSTION ENGINE

(71) Applicant: Daimler AG, Stuttgart (DE)

(72) Inventors: Alexander Gaisberg-Helfenberg, Beilstein (DE); Markus Lengfeld, Leutenbach (DE); Jens Meintschel, Bernsdorf (DE); Thomas Stolk, Kirchheim (DE)

(73) Assignee: Daimler AG, Stuttgart (DE)

( * ) Notice: Subject to any disclaimer, the term of this patent is extended or adjusted under 35 U.S.C. 154(b) by 193 days.

(21) Appl. No.: 14/888,192

(22) PCT Filed: Mar. 15, 2014

(86) PCT No.: PCT/EP2014/000698
§ 371 (c)(1),
(2) Date: Oct. 30, 2015

(87) PCT Pub. No.: WO2014/177238
PCT Pub. Date: Nov. 6, 2014

(65) Prior Publication Data

US 2016/0069228 A1 Mar. 10, 2016

(30) Foreign Application Priority Data

May 2, 2013 (DE) ..... 10 2013 007518

(51) Int. Cl.
*F01L 1/352* (2006.01)

(52) U.S. Cl.
CPC ..... *F01L 1/352* (2013.01); *F01L 2001/3522* (2013.01)

(58) Field of Classification Search
CPC .... F01L 1/344; F01L 1/352; F01L 2001/3552
(Continued)

(56) References Cited

U.S. PATENT DOCUMENTS 3,317,009 A * 5/1967 Warwick ..... F16D 55/2255 188/71.8
4,227,783 A * 10/1980 Drasch ..... B23Q 3/1543 352/177

(Continued)

FOREIGN PATENT DOCUMENTS

DE 10 2008 060 926 A1 6/2010
DE 10 2009 012 137 A1 9/2010

(Continued)

OTHER PUBLICATIONS

Machine Translation of DE102008060926A1.*

(Continued)

*Primary Examiner* — Thai Ba Trieu
*Assistant Examiner* — Loren C Edwards
(74) *Attorney, Agent, or Firm* — Crowell & Moring LLP

(57) ABSTRACT

An adjusting device, in particular for adjustment of a camshaft of an internal combustion engine, is disclosed. The adjusting device includes a brake unit which has at least one brake disc and at least one electromagnet for actuating the brake unit. The electromagnet has a yoke and an armature formed separately from the brake disc, where the brake disc is disposed at least partially spatially between the yoke and the armature of the electromagnet.

8 Claims, 3 Drawing Sheets

(58) Field of Classification Search
USPC ..... 123/90.11, 90.15, 90.17
See application file for complete search history.

(56) References Cited

U.S. PATENT DOCUMENTS

| | | | | | |
|---|---|---|---|---|---|
| 5,490,583 | A * | 2/1996 | Anderson | ..... | F16D 55/36<br>188/161 |
| 5,826,683 | A * | 10/1998 | Murata | ..... | F16D 65/18<br>188/161 |
| 6,161,659 | A * | 12/2000 | Maurice | ..... | B60T 1/065<br>188/161 |
| 6,457,446 | B1 * | 10/2002 | Willmot | ..... | F01L 1/352<br>123/90.15 |
| 2002/0038639 | A1 | 4/2002 | Mae et al. | | |

FOREIGN PATENT DOCUMENTS

| | | | | | |
|---|---|---|---|---|---|
| DE | 102008060926 | A1 * | 10/2010 | ..... | F01L 1/352 |
| JP | 2004-162565 | A | 6/2004 | | |
| JP | 2014-528547 | A | 10/2014 | | |
| WO | WO 2013/053415 | A1 | 4/2013 | | |

OTHER PUBLICATIONS

Japanese Office Action issued in Japanese counterpart application No. 2016-510956 dated Sep. 27, 2016, with partial English translation (Six (6) pages).

PCT/EP2014/000698, International Search Report (PCT/ISA/220 and PCT/ISA/210) dated Apr. 24, 2014, with partial English translation, enclosing Written Opinion of the International Searching Authority (PCT/ISA/237) (Thirteen (13) pages).

* cited by examiner

ADJUSTING DEVICE, IN PARTICULAR FOR ADJUSTING A CAMSHAFT OF AN INTERNAL COMBUSTION ENGINE

BACKGROUND AND SUMMARY OF THE INVENTION

The invention relates to an adjusting device, in particular for adjustment of a camshaft of an internal combustion engine.

An adjusting device is already known for adjustment of a camshaft of an internal combustion engine, with a brake unit which has at least one brake disc, and with at least one electromagnet for actuating the brake unit, the electromagnet having a yoke and an armature formed separately from the brake disc.

The object of the invention in particular is to provide a particularly reliable brake unit for an adjusting device, in particular for adjusting a camshaft of an internal combustion engine.

The starting point for the invention is an adjusting device, in particular for adjustment of a camshaft of an internal combustion engine, with a brake unit which has at least one brake disc, and with at least one electromagnet for actuating the brake unit, the electromagnet having a yoke and an armature formed separately from the brake disc.

It is proposed that the brake disc is disposed at least partially spatially between the yoke and the armature of the electromagnet. Due to an armature formed separately from the brake disc, the brake disc may be designed to be particularly thin, so that the inertia of the brake disc as well as a time constant of the controller can be reduced. Because the brake disc is disposed spatially between the yoke and the armature, the electromagnet can be designed as a pull magnet which has few parts in particular by comparison with a push magnet, so that a particularly compact, cost-effective and reliable brake unit can be provided. A "coil" of an electromagnet should be understood in particular to be a component with a wound electrical conductor which is provided so that, at least in an activation state of the brake unit, an electric current flows through it and a magnetic field is generated. A "yoke" of an electromagnet should be understood in particular to be a magnetic conductor which is surrounded at least in a region by the coil and which is disposed immovably with respect to the coil and in particular is provided in order to conduct the magnetic field of the coil. An "armature" of an electromagnet should be understood in particular to be a movably mounted magnetic conductor which is provided in order to be moved by a force produced by the magnetic field of the coil. "Provided" should be understood in particular to mean especially 'designed,' 'equipped,' and/or 'disposed.'

Furthermore, it is proposed that the armature and the yoke each have at least one friction surface which are each provided in order to exert, at least in an activation state of the brake unit, a force on the brake disc. Because both the yoke and the armature exert a force on the brake disc, a particularly effective braking device can be provided. A "friction surface" should be understood in particular to be a surface which is provided in order to be, at least in an activation state of the brake unit, in contact with a corresponding surface of the brake disc, so that a braking force is generated which counteracts a rotary movement of the brake disc. The friction surface preferably has a brake lining which is provided in order to increase the generated braking force. The friction surface of the armature and the friction surface of the yoke are preferably disposed on different sides of the brake disc in a mirror image and facing one another relative to the brake disc. Particularly preferably the friction surfaces are congruent with one another, i.e. they have an identical shape.

Furthermore it is proposed that the forces exerted on the brake disc by the yoke and the armature are opposed to one another. In this way, axial forces on the brake disc can be avoided. Any effects of tolerances, thermal expansion and occurring wear can be compensated for and the durability of the brake unit can be increased. The fact that the forces exerted on the brake disc "are opposed to one another" should in particular be understood in this context to mean that, in an activation state of the brake unit, these forces impinge on two directly opposing surfaces of the brake disc and are oriented antiparallel relative to one another. The brake disc is preferably supported so as to be axially movable, so that the force of the yoke acts as an opposing force to the force of the armature acts, i.e. the force of the yoke and the force of the armature have the same value.

Furthermore it is proposed that the yoke and the armature are disposed on opposing sides of the brake disc. As a result a residual gap between the yoke and the armature is unnecessary for compensation for tolerances and wear, and the yoke, the brake disc and the armature are in contact with one another at an operating point of the electromagnet, so that the degree of efficiency of the brake is increased. The fact that the yoke and the armature are disposed on "opposite sides" of the brake disc should in particular be understood to mean that they lie opposite one another in the axial direction with regard to the brake disc and have the same radial spacing from the axis of the brake disc, and a radius from the axis to the yoke is disposed parallel to a radius from the axis to the armature.

Furthermore it is proposed that the brake disc has at least one annular friction surface which, at least in an activation state of the electromagnet, at least in a section is penetrated at least substantially in a straight line by a magnetic flux. In this way the brake disc can be of particularly lightweight construction as the brake disc does not have to perform the function of a magnetic armature, so that the inertia of the brake disc can be decreased and a time constant when adjusting the camshaft can be reduced. The fact that the brake disc is penetrated "in a straight line by a magnetic flux" should in particular be understood to mean that, in an activation state of the brake unit, the yoke and the armature have a magnetic circuit, i.e. that a magnetic flux through a cross-section of the armature is at least substantially equal to a magnetic flux through a cross-section of the yoke. A radial component of the magnetic flux in the brake disc is preferably less than 10% of an axial component of the magnetic flux and particularly advantageously less than 5% of the axial component of the magnetic flux.

Furthermore it is proposed that the brake disc is formed at least in the region of the friction surface from a ferromagnetically soft material. In this way a magnetic resistance of the brake unit can be decreased and the degree of efficiency of the brake unit can be increased. Moreover a permanent magnetization of the brake disc and thus an undefined residual brake torque can be avoided in a non-active state of the brake unit. A "ferromagnetic material" should in particular be understood to be a material which has a high magnetic conductivity. The material preferably has a magnetic permeability greater than 10000, particularly advantageously the material has a magnetic permeability greater than 100000. A "ferromagnetically soft material" should in particular be understood to be a material which has a low residual magnetization and thus a low coercive field strength. The coercive field strength is preferably less than 2 A/m, particularly advantageously less than 1 A/m.

Furthermore it is proposed that the brake disc has at least one second friction surface and an insulation region which spatially separates the friction surfaces and is formed from a magnetically non-conductive material. As a result a radial component of the magnetic flux in the brake disc and thus a unilateral force between the yoke and the brake disc can be reduced. In this context an insulation region should be understood in particular to be an annular region which is disposed in the radial direction between two annular friction surfaces of the brake disc. A "magnetically non-conductive material" should be understood to be a diamagnetic or paramagnetic material, for example austenitic stainless steel or aluminum.

Furthermore it is proposed that the brake disc has at least one spoke in the insulation region. As a result a particularly lightweight brake disc can be provided and a radial component of the magnetic flux can be reduced. In principle it is also conceivable that the brake disc is closed in the insulation region and is particularly thin.

Furthermore it is proposed that the armature of the electromagnet is designed as a hinged armature. In this way a particularly simply designed and cost-effective brake unit can be provided. A "hinged armature" should be understood to be an armature which is rotatably mounted on one end and has an axis of rotation which is disposed in a circumferential direction of the brake disc. The hinged armature is preferably mounted in the yoke of the electromagnet and has a planar arm which is disposed substantially parallel to the brake disc.

Furthermore it is proposed that the yoke of the electromagnet has at least one arm which covers the brake disc in the radial direction. In this way a particularly compact adjusting device can be provided. The arm of the yoke has on an open end a bearing in which the hinged armature of the brake unit is supported. In principle it is conceivable that the yoke has further arms which are preferably disposed offset from one another in a circumferential direction of the brake disc.

Furthermore a restoring element is proposed which is provided in order to exert a force on the yoke and the armature which is opposed to a force exerted by the yoke and the armature on the brake disc. In this way a residual brake torque can be minimized, so that the precision and reliability are increased when the adjusting device is used. A restoring element should be understood in particular to be an elastically deformable spring element which provides a tensioning force and is disposed functionally between the yoke and the armature.

Furthermore a valve train device for an internal combustion engine is proposed, with at least one camshaft and an adjusting device according to the invention which is provided for adjustment of the at least one camshaft. The controllability of the internal combustion engine can be improved by the use of the adjusting device in a valve train device.

Further advantages can be seen from the following description of the drawings. Two exemplary embodiments of the invention are shown in FIGS. 1 to 3. FIGS. 1 to 3, the description of the drawings and the claims contain numerous features in combination. Expediently, the person skilled in the art will also consider the features singly and combine them to form meaningful further combinations.

DETAILED DESCRIPTION OF THE DRAWINGS

Figure 1:
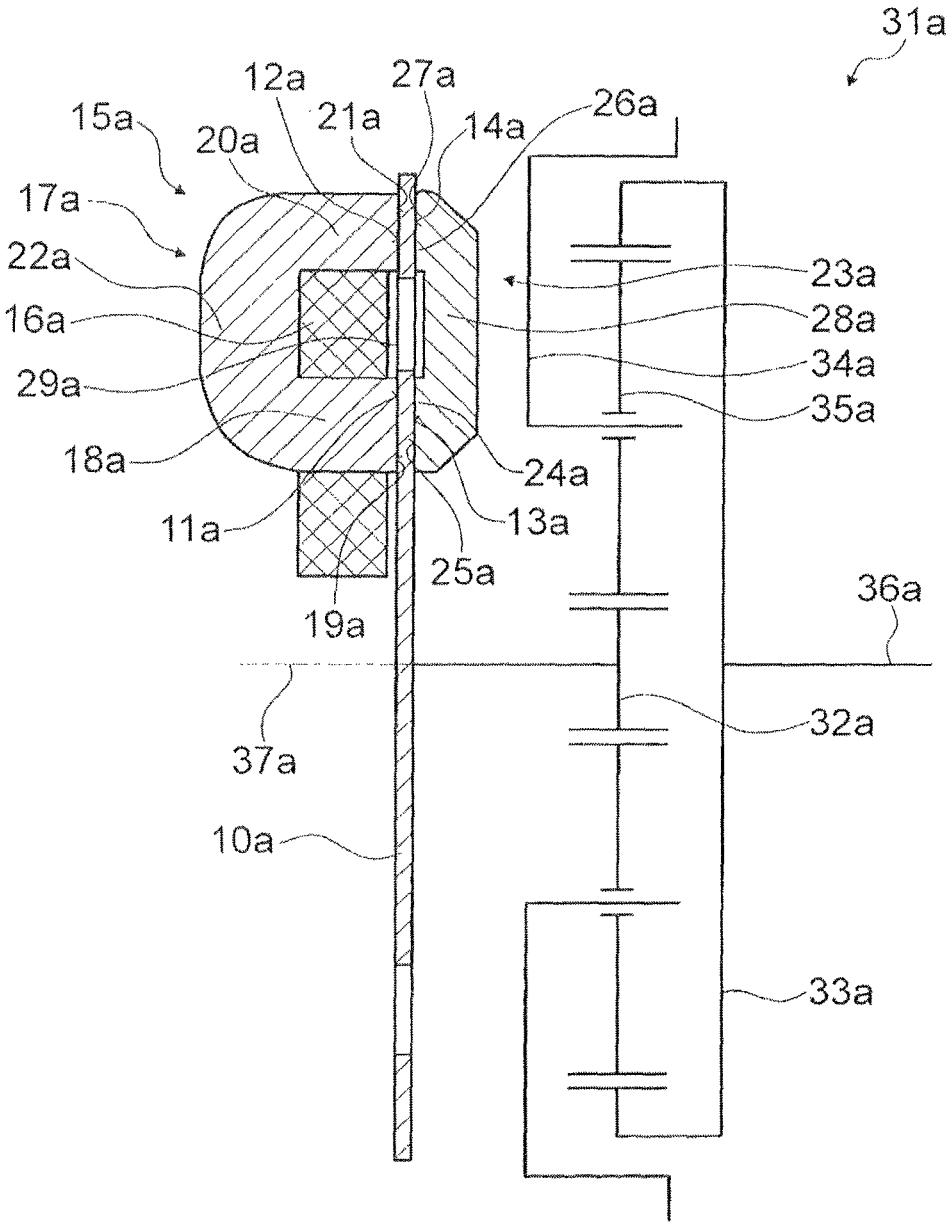
FIG. 1 a longitudinal section of an adjusting device with a brake unit and an electromagnet and a transmission in a schematic representation, FIG. 2 an exploded representation of the brake unit and the electromagnet of the adjusting device, and FIG. 3 a longitudinal section of the adjusting device with a brake unit and an electromagnet with hinged armature.
Figure 2:
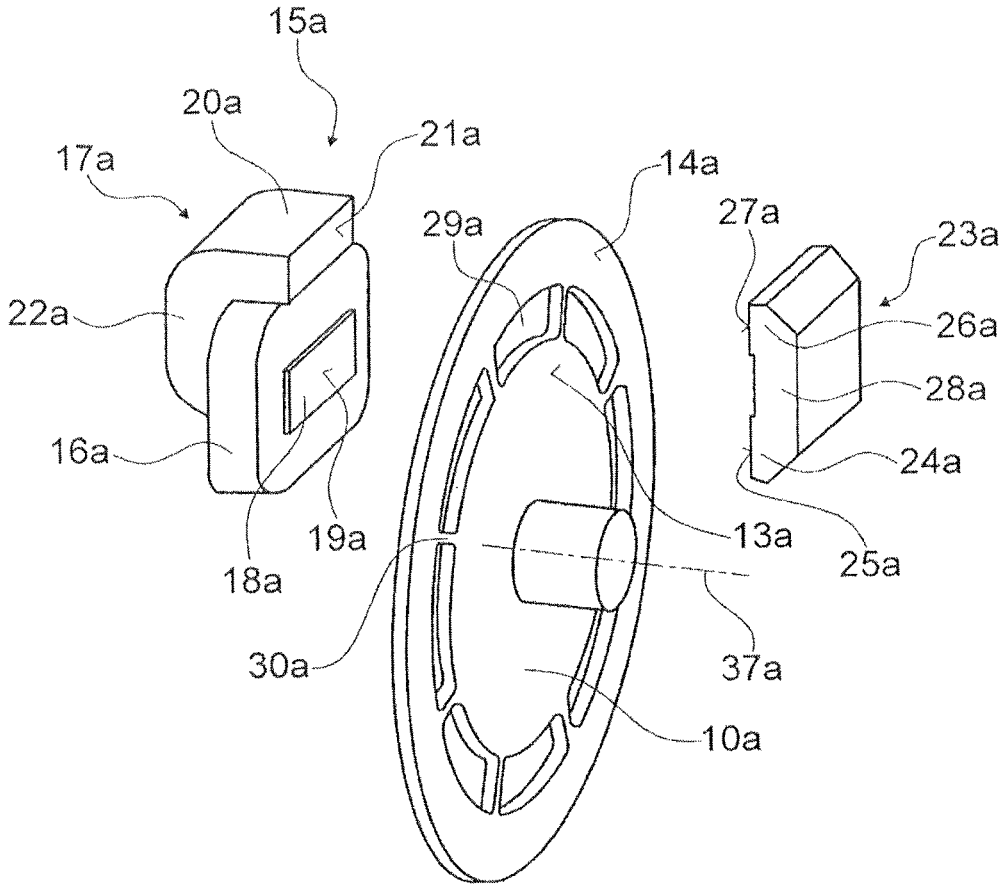

FIGS. 1 and 2 show schematically a valve train device for an internal combustion engine, with a 3-shaft minus summation gear system 31*a*. The valve train device comprises an adjusting device for adjustment of a camshaft 36*a* of the internal combustion engine, with a brake unit and an electromagnet 15*a* for actuating the brake unit. The 3-shaft minus summation gear system 31*a* comprises a sun gear 32*a*, a ring gear 33*a* and a planetary gear support 34*a*. The planetary gear support 34*a* carries planetary gears 35*a* on a circular path. The planetary gears 35*a* mesh with the sun gear 32*a* and with the ring gear 33*a*. The planetary gears 35*a* are rotatably supported on the planetary gear support 34*a*. The ring gear 33*a* is coupled to a camshaft 36*a*. The planetary gear support 34*a* is coupled to a crankshaft which is not shown in greater detail. The sun gear 32*a* is coupled to the brake unit.

The brake unit has a brake disc 10*a*. The brake disc 10*a* is designed as a circular surface and has an axis 37*a* which is disposed perpendicular to the circular surface.

The electromagnet 15*a* has a coil 16*a*, a yoke 17*a* and an armature 23*a*. The yoke 17*a* of the electromagnet 15*a* is formed from laminated material. The yoke 17*a* is in the form of a rectangular bar bent in a U shape. The yoke 17*a* has a first arm 18*a* and a second arm 20*a* and a curve 22*a*. The arms 18*a*, 20*a* are disposed parallel to one another. The curve 22*a* of the yoke 17*a* connects the two arms 18*a*, 20*a*. The arms 18*a*, 20*a* of the yoke 17*a* each have a rectangular, planar friction surface 19*a*, 21*a* on their respective open end. The electromagnet 15*a* is disposed eccentrically with respect to the axis 37*a* of the brake disc 10*a*. The friction surfaces 19*a*, 21*a* of the arms 18*a*, 20*a* are disposed parallel to the brake disc 10*a*. The arms 18*a*, 20*a* each have an axis. The axes of the arms 18*a*, 20*a* are disposed parallel to one another and parallel to the axis 37*a* of the brake disc 10*a*. The intersection points of the axes of the arms 18*a*, 20*a* with the brake disc 10*a* are disposed on a radius of the brake disc 10*a*. The first arm 18*a* has a smaller spacing from the axis 37*a* of the brake disc 10*a* than the second arm 20*a*. The first arm 18*a* and the second arm 20*a* are disposed in the radial direction on the same side of the axis 37*a* of the brake disc 10*a*.

The coil 16*a* of the electromagnet 15*a* is designed as an annular wire winding. The coil 16*a* has an axis which is disposed congruent with the axis of the first arm 18*a*. The coil 16*a* surrounds the first arm 18*a* of the yoke 17. In principle it is conceivable that the coil 16*a* of the second arm 18*a*, the curve 22*a* or the entire yoke 17*a*. The coil 16*a* and the yoke 17*a* are disposed immovably relative to one another. The coil 16*a* is provided so that an electric current flows through it and a magnetic flux is generated in the yoke 17*a* and in the armature 23*a*. The yoke 17*a* and the coil 16*a* of the electromagnet 15*a* are mounted firmly with respect to the adjusting device.

The armature 23*a* of the electromagnet 15*a* is formed separately from the brake disc 10*a*. The armature 23*a* is provided in order, in an activation state of the electromagnet 15*a*, to close a magnetic circuit together with the yoke 17*a*. The armature 23*a* is formed from laminated material. The armature 23*a* is in the form of a rectangular bar bent in a U shape. The armature 23*a* has a first arm 24*a* and a second arm 26*a* and a curve 28*a*. The arms 24*a*, 26*a* are disposed parallel to one another. The curve 28*a* of the armature 23*a* connects the two arms 24*a*, 26*a*. A ratio of the length of the arm 24*a*, 26*a* to the spacing of the arms 24*a*, 26*a* is approximately 1/15. The arms 24*a*, 26*a* of the armature 23*a* each have a rectangular, planar friction surface 25*a*, 27*a* on their respective open end. The friction surfaces 25*a*, 27*a* of the arms 24*a*, 26*a* are disposed parallel to the brake disc 10*a*. The arms 24*a*, 26*a* each have an axis. The axes of the arms 24*a*, 26*a* are disposed parallel to one another and perpendicular to the friction surfaces 25*a*, 27*a* of the arms 24*a*, 26*a*. The axes of the arms 24*a*, 26*a* are disposed parallel to the axis 37*a* of the brake disc 10*a*. The intersection points of the axes of the arms 24*a*, 26*a* with the brake disc 10*a* are disposed on a radius of the brake disc 10*a*. The first arm 24*a* has a smaller spacing from the axis 37*a* of the brake disc 10*a* than the second arm 26*a*. The friction surfaces of the arms 24*a*, 26*a* of the armature 23*a* are congruent with the friction surfaces 19*a*, 21*a* of the arms 18*a*, 20*a* of the yoke 17*a*.

The yoke 17*a* and the armature 23*a* of the electromagnet 15*a* are disposed on opposing sides of the brake disc 10*a*. The brake disc 10*a* is disposed in the axial direction between the yoke 17*a* and the armature 23*a* of the electromagnet 15*a*. The yoke 17*a* and the armature 23*a* of the electromagnet 15*a* are disposed on a plane of the brake disc 10*a* in mirror image to one another. The friction surface 19*a* of the first arm 18*a* of the yoke 17*a* is disposed, relative to the plane of the brake disc 10*a*, opposite the friction surface 25*a* of the first arm 24*a* of the armature 23*a* and the friction surface 21*a* of the second arm 20*a* of the yoke 17 is disposed, relative to the plane of the brake disc 10*a*, opposite the friction surface 27*a* of the second arm 26*a* of the armature 23*a*. The first arm 24*a* of the armature 23*a* is disposed with the same spacing from the axis 37*a* of the brake disc 10*a* as the first arm 18*a* of the yoke 17*a*. The second arm 26*a* of the armature 23*a* is disposed with the same spacing from the axis 37*a* of the brake disc 10*a* as the second arm 20*a* of the yoke 17*a*.

The armature 23*a* is axially movable and mounted in a rotationally fixed manner with respect to the axis 37*a* of the brake disc 10*a*. The yoke 17*a* of the electromagnet 15*a* is provided in order in an activation state of the brake unit to conduct a magnetic field which is generated by the coil 16*a* and which exerts a force on the armature 23*a* of the electromagnet 15*a*, so that the armature 23*a* is pulled in the direction of the yoke 17*a* and the brake disc 10*a* disposed between the yoke 17*a* and the armature 23*a*. In the activation state of the electromagnet 15*a* the friction surfaces 25*a*, 27*a* of the armature 23*a* and the friction surfaces 19*a*, 21*a* of the yoke 17*a* are in contact with the brake disc 10*a* and in each case exert a force on the brake disc 10 which produces a braking force which counteracts a rotation of the brake disc 10*a*. The force which the yoke 17*a* exerts on the brake disc 10*a* is opposed to the force which the armature 23*a* exerts on the brake disc 10*a*. In principle it is conceivable that a permanent magnet is disposed in the yoke 17*a* or in the armature 23*a*, so that a defined braking action can also be achieved in a de-energized state.

The brake disc 10*a* has a first side which faces the yoke 17*a* of the electromagnet 15*a*, and the brake disc 10*a* has a second side which faces the armature 23*a* of the electromagnet 15*a*. The brake disc 10*a* is mounted so as to be axially movable. A ratio of the thickness of the brake disc 10*a* to the thickness of the curve 28*a* of the armature 23*a* is approximately one third.

The brake disc 10*a* has an annular first friction surface 11*a* on the first side. The first friction surface 11*a* is disposed concentrically with respect to the brake disc 10*a*. The first friction surface 11*a* has an inner radius which corresponds to a spacing of the first arm 18*a* of the yoke 17*a* from the axis 37*a* of the brake disc 10*a*. The first friction surface 11*a* has a width which corresponds to a thickness of the first arm 18*a* of the yoke 17*a*. The brake disc 10*a* has an annular second friction surface 12*a* on the first side. The second friction surface 12*a* is disposed concentrically with respect to the brake disc 10*a*. The second friction surface 12*a* has an inner radius which corresponds to a spacing of the second arm 20*a* of the yoke 17*a* from the axis 37*a* of the brake disc 10*a*. The second friction surface 12*a* has a width which corresponds to a thickness of the second arm 20*a* of the yoke 17*a*.

The brake disc 10*a* has an annular third friction surface 13*a* on the second side. The third friction surface 13*a* is disposed concentrically with respect to the brake disc 10*a*. The third friction surface 13*a* has an inner radius which corresponds to a spacing of the first arm 24*a* of the armature 23*a* from the axis 37*a* of the brake disc 10*a*. The third friction surface 13*a* has a width which corresponds to a thickness of the first arm 24*a* of the armature 23*a*. The brake disc 10*a* has an annular fourth friction surface 14*a* on the second side. The fourth friction surface 14*a* is disposed concentrically with respect to the brake disc 10*a*. The fourth friction surface 14*a* has an inner radius which corresponds to a spacing of the second arm 26*a* of the armature 23*a* from the axis 37*a* of the brake disc 10*a*. The fourth friction surface 14*a* has a width which corresponds to a thickness of the second arm 26*a* of the armature 23*a*.

The first friction surface 11*a* and the third friction surface 13*a* of the brake disc 10*a* are designed to be congruent with one another. They are disposed opposite one another on the brake disc 10*a*. In a region of the first friction surface 11*a* and the third friction surface 13*a* the brake disc 10*a* is formed from a ferromagnetically soft material. The second friction surface 12*a* and the fourth friction surface 14*a* of the brake disc 10*a* are designed to be congruent with one another. They are disposed opposite one another on the brake disc 10*a*. In a region of the second friction surface 12*a* and the fourth friction surface 14*a* the brake disc 10*a* is made from a ferromagnetically soft material.

It is conceivable that the friction surfaces 11*a*, 12*a*, 13*a*, 14*a* of the brake disc 10*a* have a brake lining made of magnetically conductive material. It is also conceivable that the friction surfaces 19*a*, 21*a* of the yoke 17*a* and the friction surfaces 25*a*, 27*a* of the armature 23*a* have a brake lining which is formed from magnetically conductive material.

In an activation state of the electromagnet 15*a* the yoke 17*a* and the armature 23*a* have a magnetic flux which forms a magnetic circuit. The flux penetrates the brake disc 10*a* substantially in a straight line in the region of the first friction surface 11*a* and the third friction surface 13*a* in an axial direction. The flux penetrates the brake disc 10*a* substantially in a straight line in the region of the first friction surface 12*a* and the fourth friction surface 14*a* in the opposite direction.

In the radial direction between the first friction surface 11*a* and the second friction surface 12*a* and/or between the third friction surface 13*a* and the fourth friction surface 14*a* the brake disc 10*a* has an annular insulation region 29*a*. The insulation region 29*a* spatially separates the first friction surface 11*a* from the second friction surface 12*a*, as well as the third friction surface 13*a* from the fourth friction surface 14*a*. The insulation region 29*a* of the brake disc 10*a* is formed from a magnetically non-conductive material. The insulation region 29*a* of the brake disc 10*a* has eight spokes 30*a*. The spokes 30*a* extend in the radial direction and connect the region of the first friction surface 11*a* and the third friction surface 13*a* to the region of the second friction surface 12*a* and the fourth friction surface 14*a*.

Figure 3:
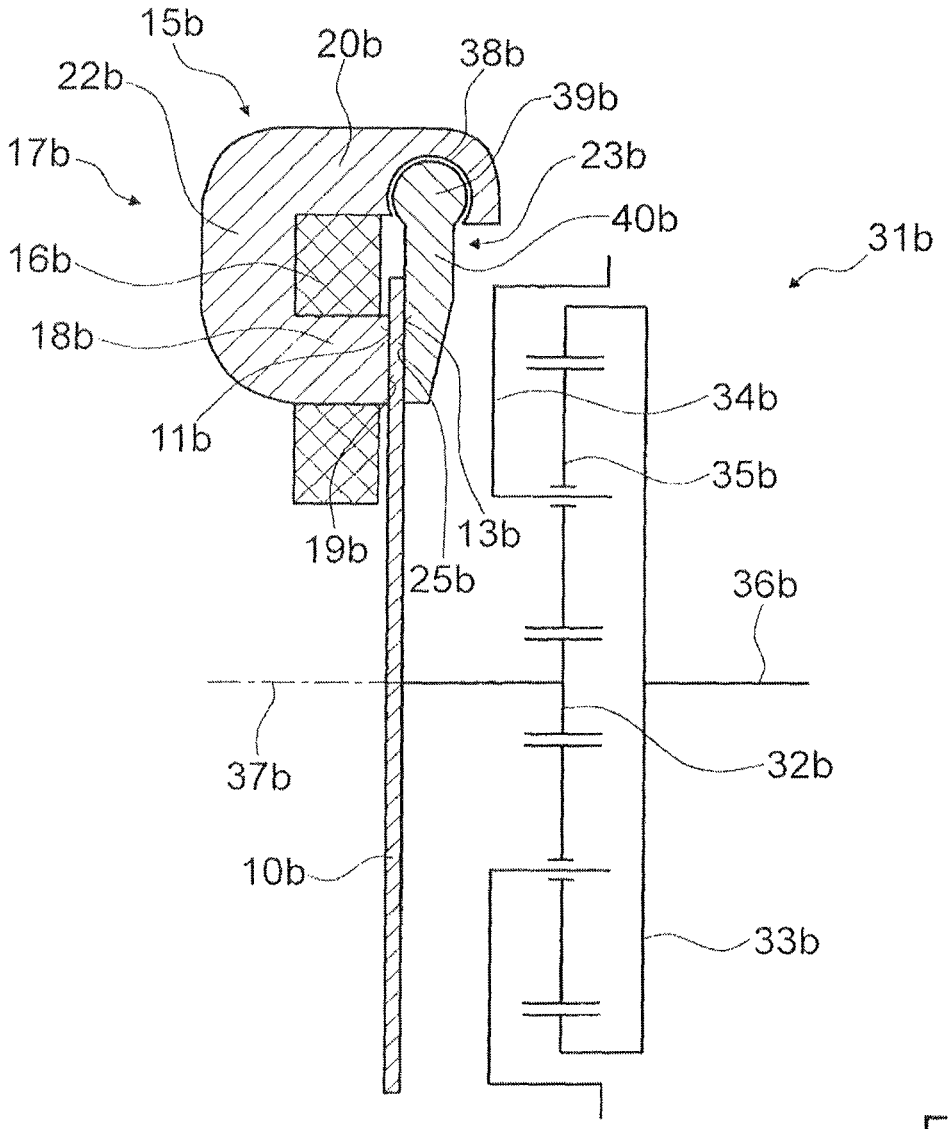

A further exemplary embodiment of the invention is shown in FIG. 3. The following descriptions are limited substantially to the differences between the exemplary embodiments wherein, with regard to components, features and functions which are the same, reference may be made to the description of the exemplary embodiment according to FIGS. 1 and 2. In order to distinguish the exemplary embodiments, the letter a in the reference signs of the exemplary embodiment in FIGS. 1 and 2 is replaced by the letter b in the reference signs of the exemplary embodiment according to FIG. 3. With regard to components with the same references, in particular with regard to components with the same reference signs, reference may in principle be made to the drawings and/or the description of the exemplary embodiment according to FIGS. 1 and 2.

FIG. 3 shows schematically a valve train device for an internal combustion engine, with a 3-shaft minus summation gear system 31*b*. The valve train device comprises an adjusting device for adjustment of a camshaft 36*b* of the internal combustion engine, with a brake unit and an electromagnet 15*b* for actuating the brake unit. The 3-shaft minus summation gear system 31*b* comprises a sun gear 32*b*, a ring gear 33*b* and a planetary gear support 34*b*. The planetary gear support 34*b* carries planetary gears 35*b* on a circular path. The planetary gears 35*b* mesh with the sun gear 32*b* and with the ring gear 33*a*. The planetary gears 35*b* are rotatably supported on the planetary gear support 34*b*. The ring gear 33*b* is coupled to a camshaft 36*b*. The planetary gear support 34*b* is coupled to a crankshaft which is not shown in greater detail. The sun gear 32*b* is coupled to the brake unit. The brake disc 10*b* is designed as a circular surface and has an axis 37*b* which is disposed perpendicular to the circular surface.

The electromagnet 15*b* has a coil 16*b*, a yoke 17*b* and an armature 23*b*. The yoke 17*b* is in the form of a rectangular bar bent in a U shape. The yoke 17*b* has a first arm 18*b* and a second arm 20*b* and a curve 22*b*. The arms 18*b*, 20*b* are disposed parallel to one another. The curve 22*b* of the yoke 17*b* connects the two arms 18*b*, 20*b*. The arms 18*b*, 20*b* each have an axis. The axes of the arms 18*b*, 20*b* are disposed parallel to one another and parallel to the axis 37*b* of the brake disc 10*b*. The first arm 18*b* has a smaller spacing from the axis 37*b* of the brake disc 10*b* than the second arm 20*b*. The first arm 18*b* of the yoke 17*b* has a rectangular, planar friction surface 19*a*, 19*b* on its open end. The electromagnet 15*b* is disposed eccentrically with respect to the axis 37*b* of the brake disc 10*b*. The friction surface 19*b* of the first arm 18*b* is disposed parallel to the brake disc 10*b*. The second arm 20*b* has a length which is greater by approximately one third than the second arm 18*b*. The second arm 20*b* covers the brake disc 10*b* in the radial direction.

The coil 16*b* of the electromagnet 15*b* is designed as an annular wire winding. The coil 16*b* has an axis which is disposed congruent with the axis of the first arm 18*b*. The coil 16*b* surrounds the first arm 18*b* of the yoke 17*b*. The yoke 17*b* and the coil 16*b* of the electromagnet 15*b* are disposed so as to be immovable with respect to one another and are mounted firmly with respect to the adjusting device.

The armature 23*b* of the electromagnet 15*b* is formed separately from the brake disc 10*b*. The armature 23*b* is provided in order, in an activation state of the electromagnet 15*b*, to close a magnetic circuit together with the yoke 17*a*. The armature 23*b* of the electromagnet 15*b* is formed as a hinged armature. The armature 23*b* has a bearing region 39*b* and an arm 40*b*. The bearing region 39*b* of the armature 23*b* is in the form of a circular cylinder. The arm 40*b* of the armature 23*b* is substantially cuboid. At a transition to the bearing region 39*b* the arm 40*b* of the armature 23*b* has a thickness of approximately two thirds of a diameter of the bearing region 39*b*. On an open end of the arm 40*b* the arm 40*b* tapers to approximately half of its thickness. The arm 40*b* of the armature 23*b* is disposed substantially parallel to the brake disc 10*b*.

The second arm 20*b* of the yoke 17*b* has a bearing seat 38*b* at its open end on a side facing the first arm 18*b*. The armature 23*b* is rotatably mounted in the bearing seat 38*b*. In a second arm 20*b* of the yoke 17*b* the bearing seat 38*b* is formed as a recess in the form of a circular cylinder segment. The circular cylinder segment has a center angle of approximately 270 degrees. In the region of the bearing seat 38*b* the second arm 20*b* has a rectangular opening which is provided so that in a fitted state the armature 23*b* extends through the opening. A diameter of the bearing seat 38*b* corresponds to a diameter of the bearing region 39*b* of the armature 23*b*. In a fitted state of the armature 23*b* an axis of the bearing region 39*b* is disposed congruent to an axis of the bearing seat 38*b*. The axis of the bearing region 39*b* and the axis of the bearing seat 38*b* are disposed perpendicular to the axis 37*b* of the brake disc 10*b* in the circumferential direction of the brake disc 10*b*. In the direction of the axis of the bearing region 39*b* the armature 23*b* is connected by positive engagement to the second arm 20*b* of the yoke 17*b*, so that a movement of the armature 23*b* in the direction of rotation of the brake disc 10*b* is prevented. A length of the arm 40*b* is coordinated with a spacing of the arms 18*b*, 20*b* of the yoke 17*b*. An end of the arm 40*b* opposite the bearing region 39*b* terminates with a side of the first arm 18*b* of the yoke 17*b* facing the axis 37*b* of the brake disc 10*b*. The arm 40*b* of the armature 23*b* covers the friction surface 19*b* of the first arm 18*b* of the yoke 17*b* in the axial direction.

The armature 23*b* is disposed on a side of the brake disc 10*b* opposite the yoke 17*b* of the electromagnet 15*b*. The brake disc 10*b* is disposed in the axial direction between the yoke 17*b* and the armature 23*b* of the electromagnet 15*b*. The arm 40*b* of the armature 23*b* has a friction surface 25*b* on a side facing the brake disc 10*b*. The friction surfaces 19*b* of the first arm 18*b* of the yoke 17*b* and the friction surface 25*b* of the arm 40*b* of the armature 23*b* are disposed opposite one another. The friction surface 19*b* of the first arm 18*b* of the yoke 17*b* and the friction surface 25*b* of the arm 40*b* of the armature 23*b* are designed to be congruent with one another.

The yoke 17*b* of the electromagnet 15*b* is provided in order, in an activation state of the brake unit, to conduct a magnetic field which is generated by the coil 16*b* and which exerts a force on the armature 23*b* of the electromagnet 15*b*, so that the armature 23*b* is turned in the direction of the yoke 17*b* and the brake disc 10*b* disposed between the yoke 17*b* and the armature 23*b*. In the activation state of the electromagnet 15*b* the friction surface 25*b* of the armature 23*b* and the friction surface 19*b* of the yoke 17*b* are in contact and each exert a force on the brake disc 10*b* which produces a braking force which counteracts a rotation of the brake disc 10*b*. The force which the yoke 17*b* exerts on the brake disc 10*b* is opposed to the force which the armature 23*b* exerts on the brake disc 10*b*.

The brake disc 10*b* has a first side which faces the yoke 17*b* of the electromagnet 15*b*. The brake disc 10*b* has a second side which faces the armature 23*b* of the electromagnet 15*b*. The brake disc 10*b* is mounted so as to be axially movable.

The brake disc 10*b* has an annular first friction surface 11*b* on the first side. The first friction surface 11*b* is disposed concentrically with respect to the brake disc 10*b*. The first friction surface 11*b* has an inner radius which corresponds to a spacing of the first arm 18*b* of the yoke 17*b* from the axis 37*b* of the brake disc 10*b*. The first friction surface 11*b* has a width which corresponds to a thickness of the first arm 18*b* of the yoke 17*b*. The brake disc 10*b* has an annular second friction surface 13*b* on the second side. The second friction surface 13*b* is disposed concentrically with respect to the brake disc 10*b*. The second friction surface 13*b* has an inner radius which corresponds to a spacing of the arm 40*b* of the armature 23*b* from the axis 37*b* of the brake disc 10*b*. The second friction surface 13*b* has a width which corresponds to a thickness of the friction surface 25*b* of the armature 23*b*. The first and the second friction surface 11*b*, 13*b* of the brake disc 10*b* are designed to be congruent with one another. They are disposed opposite one another on the brake disc 10*b*.

In an activation state of the electromagnet 15*b* the yoke 17*b* and the armature 23*b* have a magnetic flux which forms a magnetic circuit. The flux penetrates the brake disc 10*b* substantially in a straight line in the region of the friction surfaces 11*b*, 13*b* of the brake disc 10*b*.

LIST OF REFERENCE SIGNS

10 brake disc
11 friction surface
12 friction surface
13 friction surface
14 friction surface
15 electromagnet
16 coil
17 yoke
18 arm
19 friction surface
20 arm
21 friction surface
22 curve
23 armature
24 arm
25 friction surface
26 arm
27 friction surface
28 curve
29 insulation region
30 spoke
31 3-shaft minus summation gear system
32 sun gear
33 ring gear
34 planetary gear support
35 planetary gear
36 camshaft
37 axis
38 bearing seat
39 bearing region
40 arm

The invention claimed is:

1. An adjusting device for adjustment of a camshaft of an internal combustion engine, comprising:

a brake unit which has a rotary movable brake disc, wherein the rotary movable brake disc has a first friction surface on a first side of the rotary movable brake disc and a second friction surface on a second side of the rotary movable brake disc; and an electromagnet, wherein the brake unit can be actuated by the electromagnet;

wherein the electromagnet is a pull magnet and has a yoke, a coil, and an armature formed separately from the brake disc, wherein the yoke is surrounded at least in a region by the coil, wherein the yoke is disposed immovably with respect to the coil and conducts a magnetic field of the coil, wherein the armature is a movably mounted magnetic conductor, and wherein the armature is pullable in a direction of the yoke by a force produced by the magnetic field of the coil;

wherein the brake disc is disposed at least partially spatially between the yoke and the armature of the electromagnet;

wherein the yoke has a first arm, a second arm, and a first curved portion that connects the first arm and the second arm and wherein the first and the second arms each have a third friction surface on a respective open end of the first and the second arms, wherein the third friction surface has a first brake lining;

wherein the armature has a third arm, a fourth arm, and a second curved portion that connects the third arm and the fourth arm and wherein the third and the fourth arms each have a fourth friction surface on a respective open end of the third and the fourth arms, wherein the fourth friction surface has a second brake lining;

wherein the respective friction surfaces of the first and the second arms of the yoke and the third and the fourth arms of the armature exert, in an activation state of the brake unit, a respective force on the brake disc and wherein the respective friction surfaces of the first and the second arms of the yoke are congruent with the respective friction surfaces of the third and the fourth arms of the armature.

2. The adjusting device according to claim 1, wherein the force of the armature and the force of the yoke are opposed to one another.

3. The adjusting device according to claim 1, wherein the yoke and the armature are disposed on opposite sides of the brake disc.

4. The adjusting device according to claim 1, wherein the brake disc is formed at least in a region of the first and the second friction surfaces of the brake disc from a ferromagnetically soft material.

5. The adjusting device according to claim 1, wherein the brake disc has an insulation region which is formed from a magnetically non-conductive material.

6. The adjusting device according to claim 5, wherein the brake disc has a spoke in the insulation region.

7. The adjusting device according to claim 1, further comprising a restoring element, wherein the restoring element provides a force on the yoke and the armature which is opposed to a force exerted by the yoke and the armature on the brake disc.

8. A valve train device for an internal combustion engine, comprising:

a camshaft; and an adjusting device, wherein the camshaft is adjustable by the adjusting device and wherein the adjusting device comprises:

a brake unit which has a rotary movable brake disc, wherein the rotary movable brake disc has a first friction surface on a first side of the rotary movable brake disc and a second friction surface on a second side of the rotary movable brake disc; and an electromagnet, wherein the brake unit can be actuated by the electromagnet;

wherein the electromagnet is a pull magnet and has a yoke, a coil, and an armature formed separately from the brake disc, wherein the yoke is surrounded at least in a region by the coil, wherein the yoke is disposed immovably with respect to the coil and conducts a magnetic field of the coil, wherein the armature is a movably mounted magnetic conductor, and wherein the armature is pullable in a direction of the yoke by a force produced by the magnetic field of the coil;

wherein the brake disc is disposed at least partially spatially between the yoke and the armature of the electromagnet;

wherein the yoke has a first arm, a second arm, and a first curved portion that connects the first arm and the second arm and wherein the first and the second arms each have a third friction surface on a respective open end of the first and the second arms, wherein the third friction surface has a first brake lining;

wherein the armature has a third arm, a fourth arm, and a second curved portion that connects the third arm and the fourth arm and wherein the third and the fourth arms each have a fourth friction surface on a respective open end of the third and the fourth arms, wherein the fourth friction surface has a second brake lining;

wherein the respective friction surfaces of the first and the second arms of the yoke and the third and the fourth arms of the armature exert, in an activation state of the brake unit, a respective force on the brake disc and wherein the respective friction surfaces of the first and the second arms of the yoke are congruent with the respective friction surfaces of the third and the fourth arms of the armature.

* * * * *